US008161700B2

(12) United States Patent
Scalise

(10) Patent No.: US 8,161,700 B2
(45) Date of Patent: Apr. 24, 2012

(54) TILED STRUCTURES AND BRACKETS THEREFOR

(76) Inventor: David H. Scalise, Morganton, NC (US)

( * ) Notice: Subject to any disclaimer, the term of this patent is extended or adjusted under 35 U.S.C. 154(b) by 0 days.

(21) Appl. No.: 12/657,139

(22) Filed: Jan. 14, 2010

(65) Prior Publication Data

US 2011/0167746 A1 Jul. 14, 2011

(51) Int. Cl.

| | |
|---|---|
| ***E04F 13/08*** | (2006.01) |
| ***E04F 19/00*** | (2006.01) |
| ***A47K 3/16*** | (2006.01) |
| ***A47K 3/024*** | (2006.01) |
| ***A47K 3/00*** | (2006.01) |

(52) U.S. Cl. ..... 52/391; 52/27; 52/34; 52/36.4; 52/36.5; 4/611; 4/604; 4/571.1

(58) Field of Classification Search ..... 52/27, 34, 52/36.4, 36.5, 391; 4/559, 571.1, 572.1, 4/573.1, 574.1, 575.1, 576.1, 577.1, 578.1, 4/579, 604, 611

See application file for complete search history.

(56) References Cited

U.S. PATENT DOCUMENTS

| | | | | |
|---|---|---|---|---|
| 2,139,905 | A | 12/1938 | Meyrick | |
| 3,260,021 | A | 7/1966 | Katz | |
| 3,640,041 | A | 2/1972 | Michieli | 52/390 |
| 3,714,907 | A | 2/1973 | Michieli | |
| 5,542,218 | A | 8/1996 | Rompel | 52/34 |
| 5,822,937 | A | 10/1998 | Mahony et al. | 52/386 |
| 6,052,845 | A | 4/2000 | Harvey | 4/611 |
| 6,301,725 | B1 | 10/2001 | Harvey | 4/611 |
| 6,588,030 | B1 | 7/2003 | Wulff | 4/605 |
| 7,383,670 | B1 | 6/2008 | Meyers | 52/720.1 |
| 7,673,420 | B2 * | 3/2010 | Madesh | 52/34 |
| 7,950,078 | B2 * | 5/2011 | Houpt | 4/578.1 |
| 7,987,535 | B1 * | 8/2011 | Tesch | 4/611 |
| 2007/0101492 | A1 * | 5/2007 | Blankenship et al. | 4/611 |
| 2008/0172963 | A1 * | 7/2008 | Harrison | 52/287.1 |
| 2009/0025139 | A1 | 1/2009 | Houpt | 4/578.1 |
| 2009/0077903 | A1 | 3/2009 | Madesh | 52/36.4 |
| 2009/0183306 | A1 * | 7/2009 | Kik et al. | 4/611 |
| 2009/0217452 | A1 * | 9/2009 | Rubin et al. | 4/576.1 |
| 2010/0186328 | A1 * | 7/2010 | Harrison | 52/287.1 |

FOREIGN PATENT DOCUMENTS

WO PCT/US2011/021064 7/2011

OTHER PUBLICATIONS

FinPan brochure, "PreFormed™ Tile Ready Shower Seat," Fin Pan, Inc. P.O. Box 411, Hamilton, OH 45012, 2 pages.

TCNA technical services, "Mortar, Thinset, Dryset, Polymer-Modified Mortar," www.tileusa.com; Nov. 17, 2009, 4 pages.

* cited by examiner

*Primary Examiner* — Mark Wendell

(74) *Attorney, Agent, or Firm* — K&L Gates LLP

(57) ABSTRACT

A tiled structure comprises a layer of adhesive mortar, a bracket having a substantially flat base mounting portion with a plurality of perforations embedded in an adhesive mortar with the mortar flowed through the perforations and substantially covering opposite sides of the base mounting portion, and a tile veneer bonded to the adhesive mortar over at least one side of the base mounting portion.

24 Claims, 8 Drawing Sheets

TILED STRUCTURES AND BRACKETS THEREFOR

BACKGROUND OF THE INVENTION

The present invention relates generally to the fabrication of tiled structures, particularly vertical tiled structures such as include but are not limited to tiled bathroom and kitchen walls, partitions, doors, drawer fronts, and the like, and relates more particularly to the mounting of accessories on such tiled structures, such as include but are not limited to seats, shelves, other horizontal supports, trays (such as soap trays and dishes), baskets, bars (such a towel bars), rings (such as towel rings), hooks, hangers, knobs, pulls, artwork, and other accessory elements which project outwardly from the tiled structure.

As used herein, the term "tile" is intended to have a broad inclusive meaning as encompassing any and all forms of stone, ceramic, clay, concrete, cement, polymeric, and composite materials, both natural and synthetic, and including those currently known and hereafter developed or discovered, suitable for use in tile veneer applications, such as tiled walls. Tile veneer walls are commonly used in both residential and commercial bathrooms and kitchens to provide a decorative but also sturdy water-resistant wall surface. Basically, tile walls are constructed of a structural substrate, typically a cement board, and/or a sand cement wire lathe composition, or another similarly strong and porous material, to which pieces of tile (which may be in any of numerous shapes and sizes) are adhesively secured as a veneer via an adhesive mortar, commonly a so-called thin-set mortar. The tile pieces are usually spaced apart a uniform distance and the wall is typically finished by applying a cementitious grout material to fill the inter-tile spaces.

In many tile wall installations, it is desirable and commonplace to mount various accessories to the outer wall surface for both functional and decorative purposes. By way of example but without limitation, such accessories in common bathroom, kitchen and like wet and/or working areas may include seats, other horizontal supports such as shelves, trays, baskets, support bars, support rings, hooks, hangers, knobs, pulls, artwork, and other elements or components adapted for various support or storage functions. As used herein, the term "accessories" is therefore also intended to have a broad inclusive meaning encompassing any and all of the foregoing types of accessories, and others not mentioned, both currently known and hereafter developed or discovered.

These types of elements or components are typically installed in one of two ways. In some cases, the component or elements may be formed of a tile material in a configuration compatible to that of the tiles used for the wall veneer so as to be suitable to be bonded via the adhesive mortar in the same manner as the tiles themselves. This manner of installation is commonly used only for light-duty accessories which will support only lightweight items without significant stress on the accessory, e.g., a soap dish or tray. Even so, these accessories may still be at risk of breakage or undesired removal from the wall if heavier objects are placed on the accessory or if undue manual force is exerted against the accessory. In other cases, particularly for components and elements made of non-tile materials, such accessories are commonly mounted by screws or like fasteners drilled or otherwise penetrated into the wall, typically through both the tile veneer and into or through the underlying substrate. This manner of mounting, if performed successfully, provides a relatively stronger structural support for the accessory, but there is a substantial risk of breakage or damage to the tile veneer and/or weakening of the structure of the substrate, and furthermore risks water infiltration into the wall through the openings that are necessarily formed. Penetration of a tiled wall structure also risks damage to in-wall systems such as electrical wiring, plumbing, or the like.

There is therefore an unsatisfied need in the relevant industry for a means of securing accessories of all types, but particularly wall accessories intended for load-bearing support purposes, with a high level of structural strength but without requiring that the tile veneer or the underlying wall structure be penetrated to accomplish mounting of the accessories.

In addition to the traditional uses of tiles as a veneer for wall surfaces, tiles of differing types are coming into increased use in other non-traditional architectural and related applications, and may be found as a functional or decorative covering for other structures ranging from doors, partitions, drawer fronts, to free-standing artistic structures. Several reasons exist which have limited the expansion of the use of tile to such non-traditional applications. In many of such applications, a substrate in the conventional form of a cement board or other common tile backer board is not present and not desirable or even reasonably possible, but other structural elements may be present to serve as a substrate. In other non-traditional applications, there may be no suitable structural element capable of serving as a substrate to which tile may be adhered.

Hence, there is also an unsatisfied need for a means of mounting tile as a veneer or covering in non-traditional architectural, artistic and other applications in which a traditional tile substrate is not present or not possible.

SUMMARY OF THE INVENTION

The present invention seeks to address the above-described needs of the tile industry, to overcome the disadvantages of current installation techniques used in the industry, and to enable expanded uses of tile in new applications not previously considered feasible. Basically, the present invention proposes the use of a novel form of support bracket by which tile may be installed with or without a traditional form of substrate. In various embodiments, the bracket of the present invention is particularly adapted for use in traditional tile applications to enable the mounting and support of accessories, such as to a vertical tiled wall structure, without requiring fasteners which must penetrate the wall structure.

Most basically, the present invention provides a bracket comprising a base mounting portion having a plurality of perforations, which is capable of load-bearing structural support of tile and accessories, with or without the presence of a traditional or other form of substrate. Thus, a tiled structure according to the present invention basically comprises a layer of adhesive mortar, with the base mounting portion of the bracket being embedded in the adhesive mortar with the mortar flowed through the perforations and substantially covering opposite sides of the base mounting portion, and a tile veneer bonded to the adhesive mortar over at least one side of the base mounting portion.

Various embodiments of the bracket and various embodiments of tile structures incorporating such brackets are contemplated. In accordance with one embodiment of the invention, the present bracket comprises a base mounting portion and a support portion rigidly affixed to the base mounting portion and projecting outwardly therefrom. The base mounting portion has a plurality of perforations therethrough for embedding of the base mounting portion in the adhesive mortar of a tile structure in abutting relation to a substrate to secure the base mounting portion thereto, with the mortar flowing through the perforations to substantially cover opposite sides of the base mounting portion for also adhering the tile veneer over the base mounting portion, with the support portion projecting outwardly beyond the tile veneer to receive an accessory. In this manner, the bracket of the present invention becomes integrated into the tile structure as part of the process of applying the tile veneer, and in turn the bracket is secured with as much or greater structural strength than with penetrating fasteners, but avoiding all of the potential disadvantages thereof.

In various embodiments of the invention, the support portion of the bracket may have differing configurations to accommodate the affixation to the support portion of any of various forms of accessories. For example, the support portion may comprise a generally flat surface for supporting a planar accessory such as a seat or other form of shelf accessory, e.g., via a layer of adhesive mortar bonding the planar accessory to the support portion, and toward that end, the support portion may have a plurality of perforations therethrough for flow of the mortar through the perforations. In one particular embodiment, the support portion may be adapted for bonding of a first shelf member (or other planar accessory) to one side of the support portion and a second shelf member (or other planar accessory) to an opposite side of the support portion.

The bracket may be adapted for affixation to a single flat extent of the tiled structure or the bracket may comprise first and second base mounting portions angularly oriented to one another for affixation to the tiled structure at a correspondingly angled corner thereof. Such a configuration of the bracket may be particularly advantageous for installation of a seat, e.g., in a shower stall, with sufficient strength to support a person's seated weight.

In other embodiments, the support portion may comprise one or more stud portions configured for receiving a fastener element of an accessory, e.g., as may be appropriate for installation of storage trays or baskets made of non-tile material such as stainless steel, brass or other metals. Such embodiments of the bracket may also be configured with first and second angularly oriented base mounting portions for affixation to a corresponding corner of the tiled structure, and in such embodiments, the support portion may comprise first and second stud portions projecting respectively from the first and second base mounting portions to support a corner accessory such as a support basket or tray.

Another aspect of the invention provides for various novel tiled structures incorporating differing brackets of the present invention. One such tiled structure in accordance with this invention comprises a substrate, with a layer of adhesive mortar bonded to the substrate. A bracket of the described type comprising a perforated base mounting portion and a support portion rigidly affixed to the base mounting portion and projecting outwardly therefrom, has the base mounting portion embedded in the adhesive mortar in abutting relation to the substrate securing the base mounting portion thereto with the mortar flowed through the perforations and substantially covering opposite sides of the base mounting portion. A tile veneer is bonded to the adhesive mortar over the base mounting portion with the support portion projecting outwardly beyond the tile veneer, and an accessory is affixed to the support portion. In this manner, the accessory may be supported without fasteners penetrating the tile veneer or the substrate.

In a representative tiled structure according to the invention, the tile veneer comprises a plurality of individual tiles adjacently arranged over the substrate at spacings defining joints between adjacent tiles, with the support portion projecting outwardly through a joint between adjacent tiles. Typically, both the substrate and the tile veneer are porous for penetration thereof by the adhesive mortar. The adhesive mortar preferably comprises a thin-set mortar, most preferably a polymer-modified thin-set mortar. The tiled structure will often be a vertical wall with the substrate in an upright orientation, and the accessory will typically be a wall accessory, but the invention is not so limited. Representative wall accessories may be a seat or other form of shelf, a tray, a basket, a support bar, a support ring, a hook, a hanger, a knob, a pull, or an item of art.

In accordance with other embodiments of the invention, the bracket may serve as the skeletal load-bearing structure for a tiled structure, basically serving as a structural substrate and obviating any need for another substrate. Thus, the base mounting portion of the bracket is embedded in the adhesive mortar with a tile veneer bonded to the adhesive mortar over at least one side of the base mounting portion and, optionally over both sides of the base mounting portion. Various tile structure applications are thereby possible, e.g., self-standing tiled wall art structures. In such embodiments, the bracket may or may not include an outwardly projecting support portion.

Further features, specifications, applications and advantages of the invention will be described and will be apparent to persons skilled in the relevant art from the following description of representative preferred embodiments with reference to the accompanying drawings.

DETAILED DESCRIPTION OF THE PREFERRED EMBODIMENTS

Figure 1:
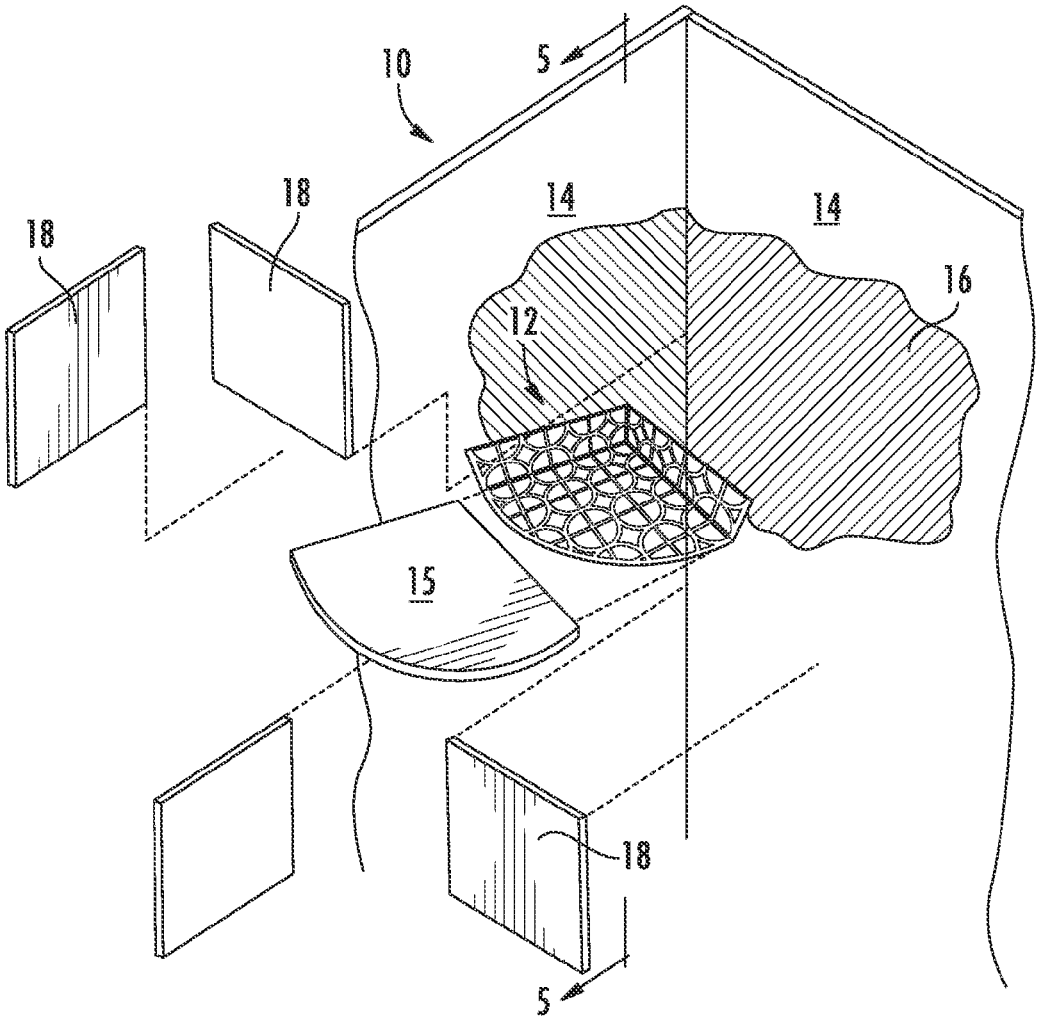
FIG. 1 is a perspective view, in exploded form, depicting one embodiment of the bracket of the present invention as installed in a tiled wall structure for supporting a wall accessory.

Referring now to the accompanying drawings and initially to FIG. 1, a tiled wall structure, generally indicated overall at 10, is depicted in exploded form as constructed utilizing an embodiment of the bracket of the present invention, generally indicated that 12, for incorporating a corner seat accessory 15 into the wall structure 10. As is commonplace and well-known to persons of skill in the relevant art, the tiled wall structure 10 basically comprises an upstanding structural substrate 14 of a rigid but porous structural material, a layer of an adhesive mortar applied over the entire surface of the substrate but only representatively indicated at 16 over a portion of the substrate, and an array of decorative tiles adhered to the mortar 16 at uniform edge-spacings over the entire surface of the substrate, as represented by rectangular tiles 18.

The substrate 14 is of a conventional form typically fabricated of a series of boards or panels of uniform shape and size fixed in edge abutment over the entirety of the wall area to be tiled. Such boards or panels are commonly referred to as backer boards or cement boards and are commercially available from a variety of sources. Cement boards or backer boards are characteristically fabricated of a composite of differing cementitious materials, predominated by cement, together with additional aggregate and filler materials such as clay, gypsum, silica and fly ash. However, it is to be understood that substantially any form of substrate material suitable for mortar-based adhesion of tiles thereover may be utilized in the present invention.

Likewise, the tiles 18 may be of any conventional form as commonly used in bathroom, kitchen and other similar wall applications. Such tiles may be formed of various materials, often of natural materials such as granite, marble and other naturally occurring stones, or of clay, but many new synthetic and composite tiles have been developed and become commercially available over recent years. Tiles of all such materials are commercially available in a variety of shapes and sizes. The present invention is designed and intended for widespread use with substantially any or all such tile materials and, accordingly, as previously stated, the term "tile" as used herein is intended to have a substantially broad and encompassing meaning inclusive of all such types of tile, both currently known and hereafter developed or discovered.

Similarly, various forms of adhesive mortars suitable for use in bonding tiles to substrate materials in the formation of tile wall structures are well known and the present invention is contemplated to be suitable for use with substantially any form of tile-adhering mortar material. The current convention within the relevant industry is to utilize so-called thin-set mortars in the fabrication of tiled wall structures, because such mortars are formulated for ease of application in a uniform spread and achieve substantial bonding strength when set and cured. Thin-set mortars typically comprise a blend of cement, very fine sand and a water retention compound to enhance hydration. A particularly advantageous form of thin-set mortar in widespread current use and presently considered to be optimal for use with the instant invention is a polymer-modified thin-set mortar having a latex, acrylic or other polymeric additive which imparts engineered properties to the mortar, in particular enhanced bonding strength and flexibility.

As previously noted, the present invention contemplates various configurations, styles, shapes, sizes and other embodiments of brackets for use in the fabrication of diverse tile structures. Many embodiments of the bracket of the present invention are particularly intended for the construction of tiled wall structures incorporating any of various forms of wall-mounted accessories in tiled wall structures without requiring the use of wall-penetrating fasteners. The bracket 12 depicted in FIG. 1 is one representative example, particularly configured for the mounting of a corner seat (or other corner support shelf) 15 at an angular corner between adjacent abutting tile wall surfaces.

Figure 2:
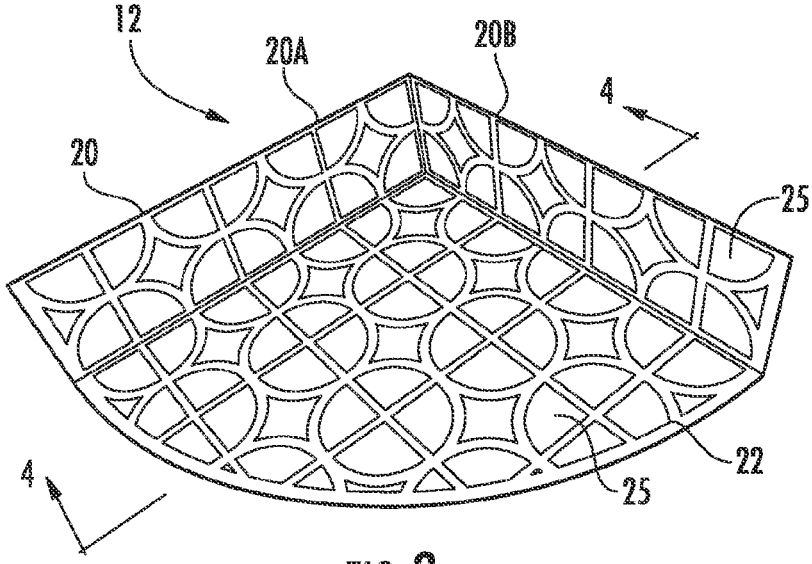
FIG. 2 is a more detailed perspective view of the wall accessory bracket of FIG. 1.
Figure 3:
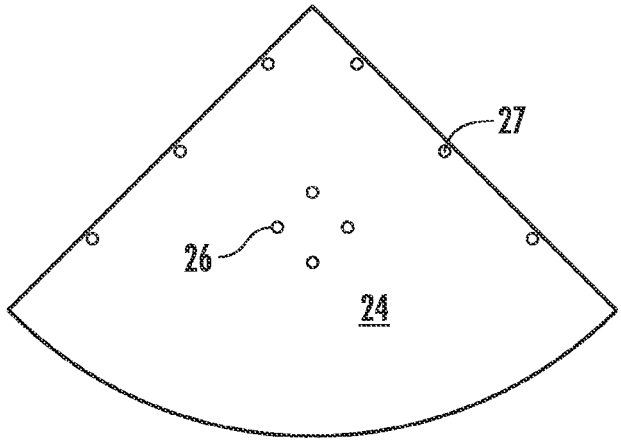
FIG. 3 is a bottom plan view of the wall accessory bracket of FIG. 2.
Figure 4:
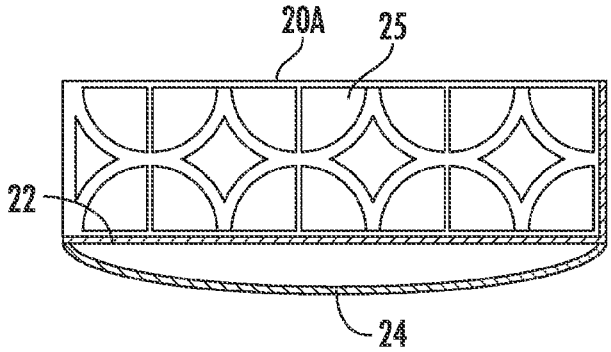
FIG. 4 is a vertical cross-sectional view of the wall accessory bracket of FIG. 2, taken along line 4-4 thereof.

The bracket 12 is best understood with reference to FIGS. 2-4. Basically, the bracket 12 is of an overall angular shape corresponding to the angular orientation between the adjacent wall surfaces and otherwise corresponding in size and shape to the desired seat or shelf. More specifically, the bracket 12 comprises an essentially flat seat/shelf support portion 22 in the shape of a 90° circular segment bounded by angularly oriented linear side edges and an arcuately curved outer edge, and a base mounting portion 20 having first and second sub-portions 20A, 20B affixed perpendicularly to one another and also respectively affixed in perpendicular relation to the linear side edges of the support portion 22. Each sub-portion 20A, 20B of the base mounting portion 20 and the support portion 22 is formed of a rigid sheet metal material, e.g., by cutting such as via a stamping process, with a plurality of perforations 25 over their entire respective surfaces defined by a series of adjacent circular rings and a series of perpendicularly-extending linear bars bisecting the rings, which collectively impart a degree of structural strength and rigidity to each of the base mounting portion 20 and the support portion 22 yet provide a relatively substantial area of open passageways through each portion. A bottom wall 24, in the shape of a 90° circular segment corresponding to the support portion 22, is affixed to the underside of the support portion 22 by welding, rivets or other suitable means, indicated at 27, as best seen in FIG. 3. The bottom wall 24 is slightly concave to provide a small spacing between the bottom wall 24 and the support portion 22, as best seen in FIG. 4. The bottom wall 24 is mostly imperforate, but has a few small openings 26 in its center for drainage.

The use of the bracket 12 in the fabrication of the tiled wall structure 10 is best understood with reference again to FIG. 1. Initially, the substrate 14 is erected, typically by the affixation of panels of cement board to an underlying stud wall (not shown) in a conventional manner. A layer 16 of a suitable thin-set mortar is then troweled over the surface of the substrate 14. The bracket 12 is then positioned at a selected location in the corner between two adjacent substrate panels in an orientation with the bottom wall 24 substantially horizontal and facing downwardly and with the sub-portions 20A, 20B of the base mounting portion 20 extending upwardly substantially in respective parallel relation to the adjacent substrate panels. The sub-portions 20A, 20B of the base mounting portion 20 are then pressed into the corner to become embedded into the mortar 16, causing a portion of the mortar 16 to flow through the perforations 25 and thereby covering both opposite sides of the two sub-portions.

The corner seat accessory 15 is similarly applied by mortar onto the top surface of the support portion 22. The corner seat accessory 15 will typically be of the same tile material as the wall tiles 18, but cut in a 90° circular segment corresponding to that of the support portion 22, typically of a slightly larger radius to provide an overhanging lip projecting beyond the support portion 22. The thin set mortar is applied over the entirety of the support portion 22 covering the upwardly facing surfaces of the support portion 22 but also penetrating through the perforations 25 therein onto the bottom wall 24. The corner seat tile 15 is then applied onto the mortared support portion 22, and thereby is securely bonded to the bracket 12. Wall tiles 18 are then applied onto the layer of mortar in a desired array (rectangular tiles such as those shown will commonly be arranged in aligned vertical columns and perpendicular horizontal rows) over the entirety of the surfaces of each substrate panel above and below the bracket 12, typically working in rows from the bottom of the wall upwardly.

Figure 5:
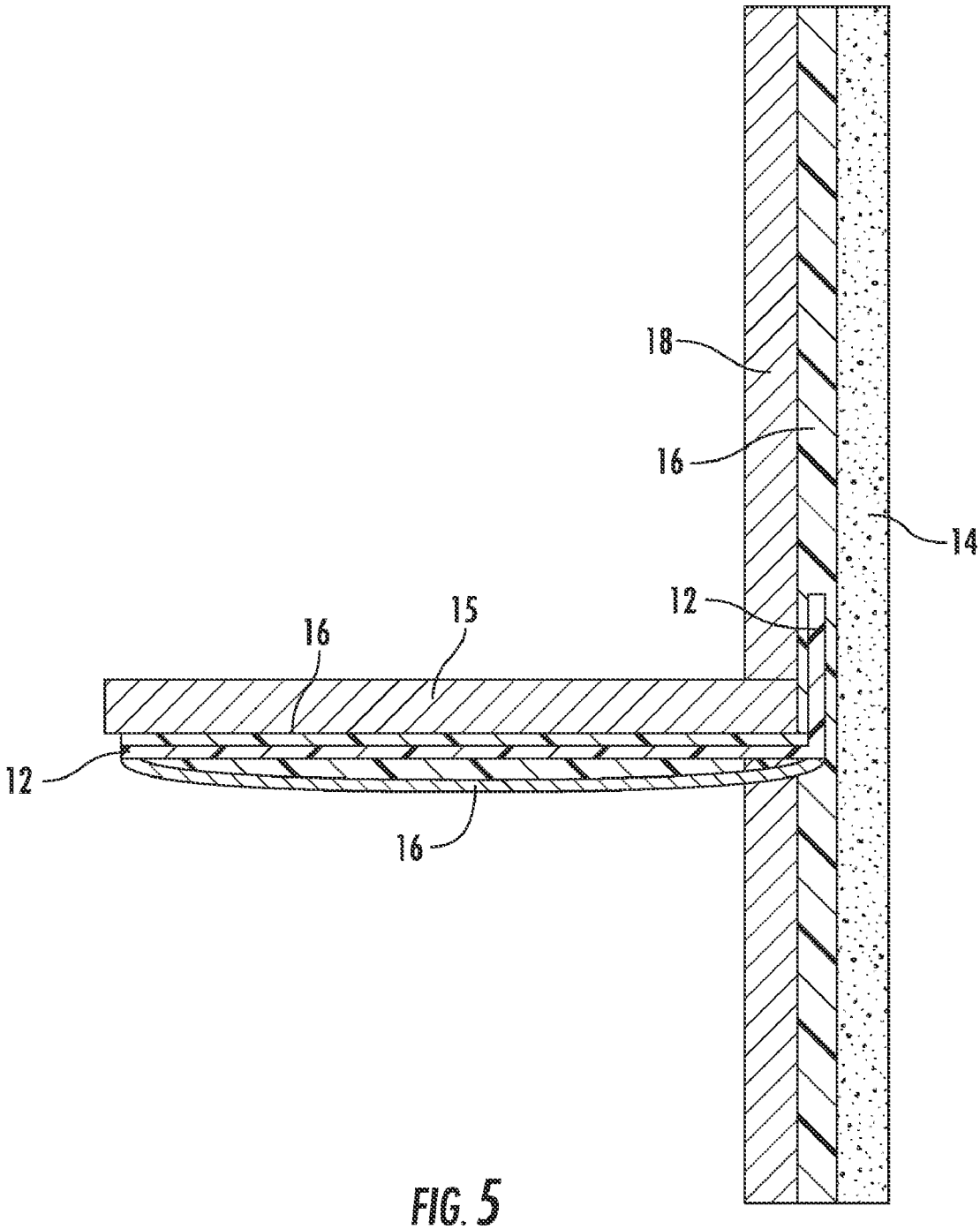
FIG. 5 is a vertical cross-sectional view taken through the finished tiled wall structure of FIG. 1 along line 5-5 thereof.

A section of the resultant wall structure 10 is depicted in FIG. 5 in fully assembled form. As previously noted, the thin-set mortar 16 provides substantial bonding strength when set and cured. Thus, the bracket 12 becomes securely bonded to the substrate panels 14 and the wall tiles 18 are similarly bonded securely to the substrate panels 14 outwardly of the sub-portions 20A, 20B above and below the bracket 12, providing supplementary support thereto. The resultant strength with which the seat tile 15 is secured to the wall structure 10 is substantial, but advantageously the mounting of the seat tile 15 does not require the use of any wall-penetrating screws or other fasteners that could potentially damage or weaken the structural components of the wall or any in-wall utilities.

Figure 6:
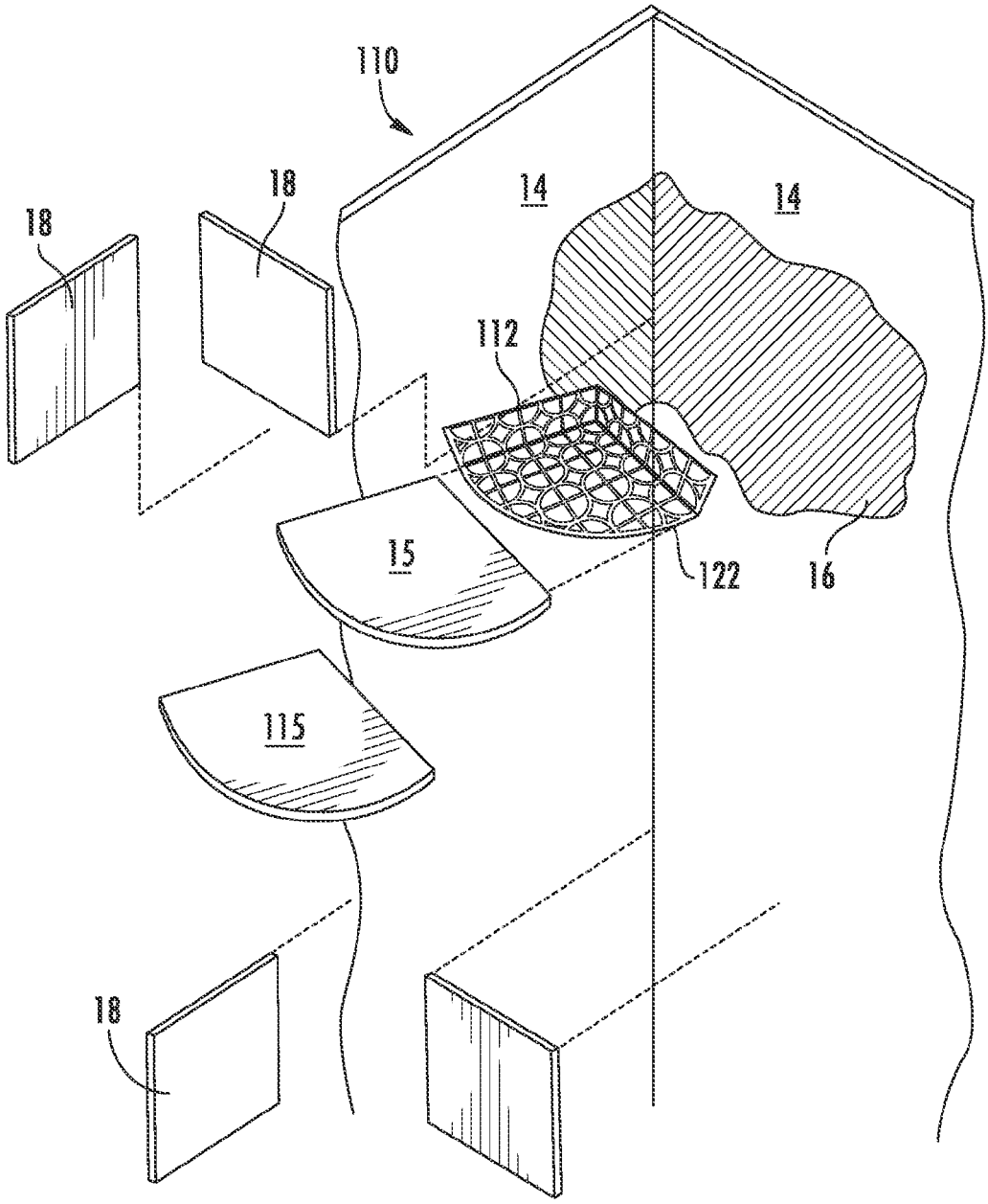
FIG. 6 is another exploded perspective view, similar to FIG. 1, depicting an alternative embodiment of the wall accessory bracket thereof in another tiled wall installation.

FIG. 6 depicts an alternative embodiment of tiled wall structure, indicated at 110, according to the present invention utilizing an alternative embodiment of bracket, indicated at 112, which is largely the same as the bracket 12 of FIGS. 1-5 except that the bracket 112 does not include a bottom wall beneath the support portion 122. Thus, upon application of the thin-set mortar 16 onto the support portion 122, the mortar 16 penetrates the perforations in the support portion 122 to also coat the bottom surface of the support portion 122 to enable a second seat tile segment 115 to be bonded to the underside of the support portion 122, thereby substantially sandwiching the support portion 122 between upper and lower seat tile segments 15, 115. This embodiment may be utilized when a more substantial corner seat is desired, or in installations wherein the corner accessory is to be used as a more elevated shelf the underside of which will be visible.

Figure 7:
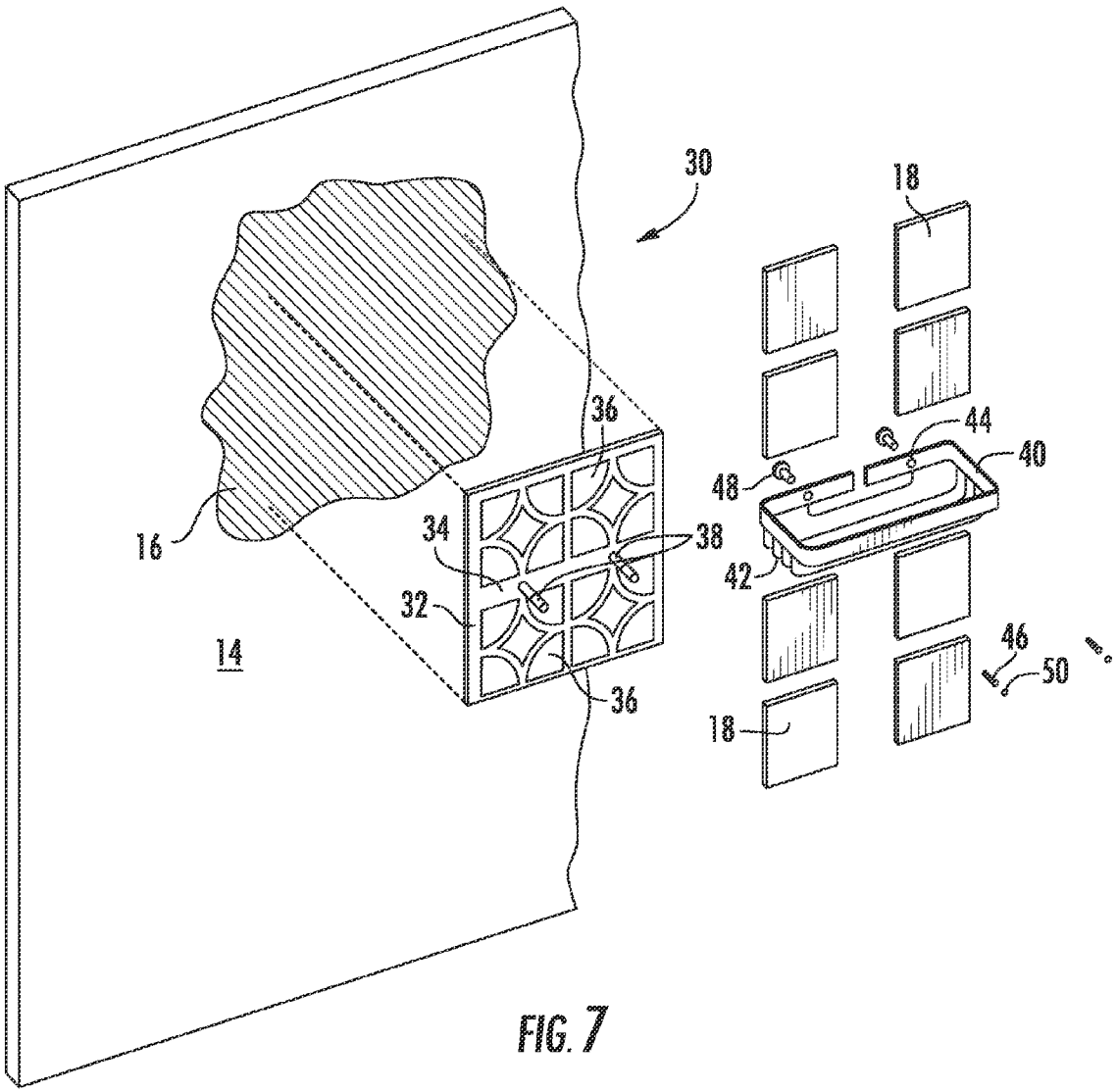
FIG. 7 is another exploded perspective view depicting another embodiment of the bracket of the present invention in another tiled wall installation for supporting another type of wall accessory.

FIG. 7 depicts another embodiment of a tiled wall structure 30 utilizing an alternative embodiment of bracket 32 adapted for supporting a tray or basket accessory 35, e.g., a stainless steel soap tray. In this embodiment, the bracket 32 is adapted for mounting to the substrate 14 along a flat wall surface, rather than as a corner. The bracket 32 has a flat rectangular base mounting portion 34, preferably stamped sheet metal, with a plurality of perforations 36 formed therein. The bracket 32 is mounted to the substrate 14 by embedding of the base mounting portion 34 into a layer of mortar applied to the substrate 14 and then covered by an array of wall tiles 18, in substantially the same manner as the installation process described above with regard to the embodiment of FIGS. 1-5. The bracket 32 also includes a support portion projecting outwardly from the base mounting portion 34, in the form of a pair of cylindrical tubular studs 38. The studs 38 have a length slightly greater than the thickness of the wall tiles 18 utilized in the wall structure 30, so as to be sufficient to project beyond the tiles 18 upon the completion of their installation. The studs 38 are sized to protrude outwardly through a joint between upper and lower tiles 18 immediately above and below the studs 38. The studs 38 are interiorly threaded so as to accept mounting screws for the soap tray 34.

The soap tray 35 may be of substantially any conventional form, a representative soap tray 35 being depicted in FIG. 7 having a main rectangular frame 40 from which are supported a series of parallel support bars 42. The frame 40 is formed with a pair of mounting openings 44 at a spacing corresponding identically to the spacing of the studs 38 of the bracket 32. The frame 40 is secured to the studs 38 via a pair of threaded mounting screws 46. Optionally, a pair of ferrules 48 may be fitted over the studs 38 immediately adjacent the wall tiles 18, either for decorative purposes or to determine a desired spacing of the soap tray 34 from the wall. A pair of caps 50 may be used to cover the head of the mounting screws 46. As in the above-described embodiments, the bracket 36 securely bonds to the substrate 14 to provide a substantially strong structural support of the soap tray 35 from the wall, without requiring wall-penetrating fasteners.

Figure 8:
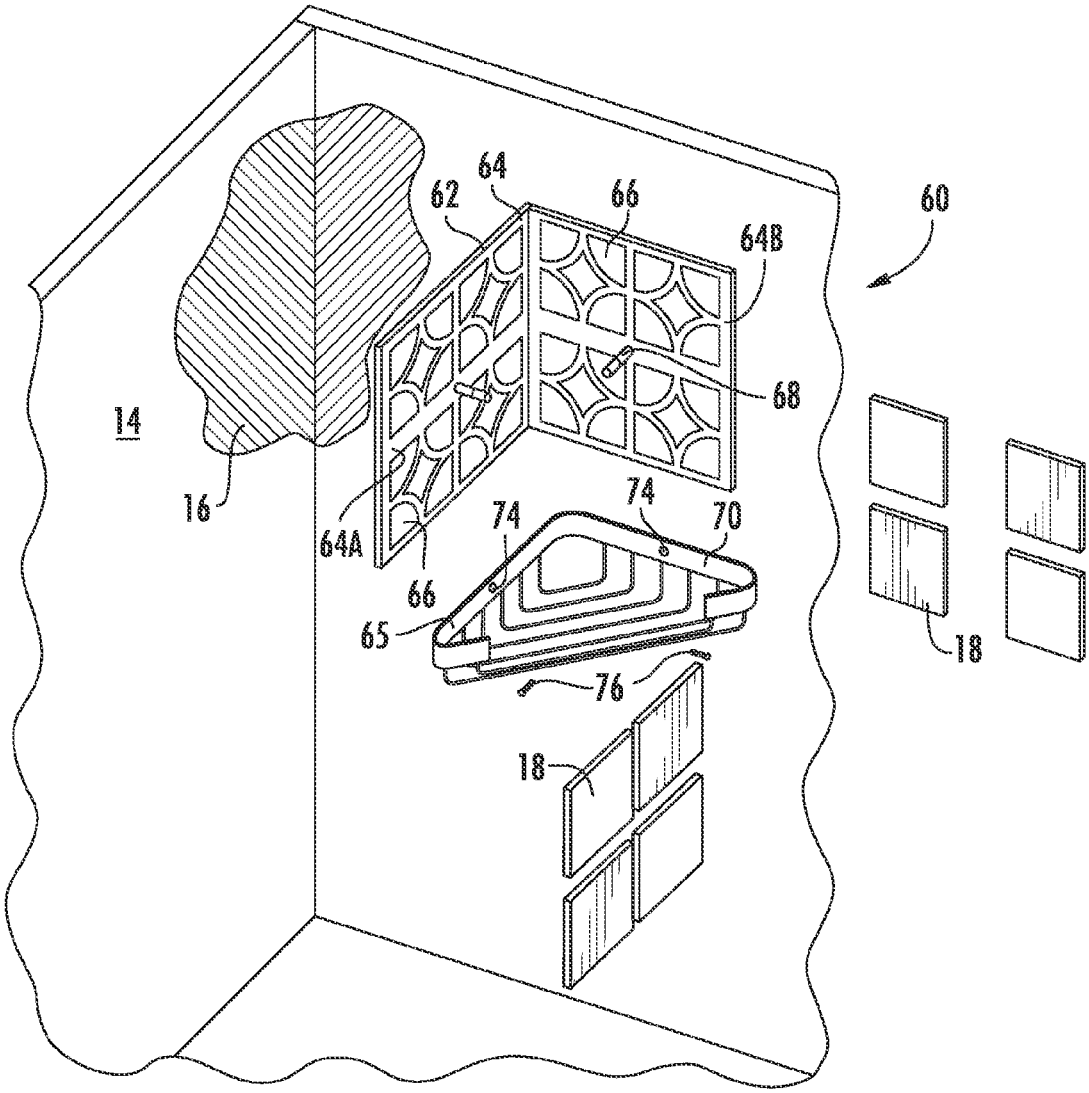
FIG. 8 is another exploded perspective view depicting another embodiment of the bracket of the present invention in another tiled wall installation for supporting another type of wall accessory.

FIG. 8 depicts another embodiment of a tiled wall structure 60 utilizing an alternative embodiment of bracket 62, similar to that of FIG. 7 but adapted for supporting a corner-mounted tray or basket accessory 65, e.g., a stainless steel shampoo/bath tray. The bracket 62 has a base mounting portion 64, preferably stamped sheet metal, having first and second flat sub-portions 64A, 64B, joined perpendicularly to one another, each with a plurality of perforations 66 formed therein and each having an internally-threaded cylindrical tubular stud 68 projecting outwardly. The bracket 62 is mounted to the substrate 14 by embedding of the base mounting portion 64 into a layer of mortar 16 at a corner of the substrate 14 and then covered by an array of wall tiles 18, in substantially the same manner as the installation process described with regard to FIG. 7 above. The shampoo/bath tray 65 has a main triangular frame 70 formed with a pair of mounting openings 74 spaced correspondingly to the studs 68 of the bracket 62 and is secured to the studs 68 via a pair of threaded mounting screws 76. A pair of ferrules (not shown) and cover caps (also not shown) may also be utilized in the installation of the shampoo/bath tray 65. Hereagain, wall-penetrating fasteners are not required.

Figure 9:
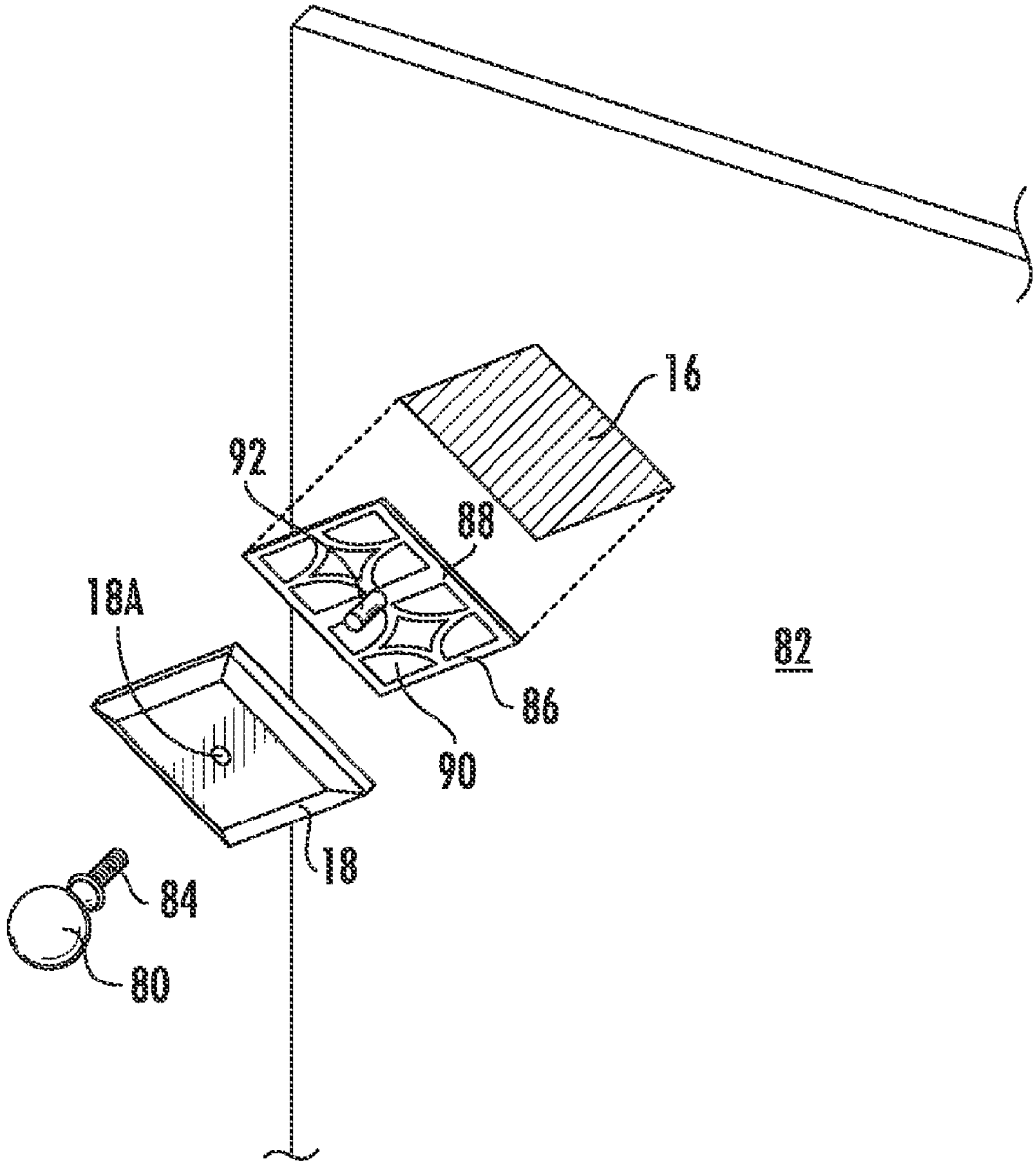
FIG. 9 is another exploded perspective view depicting another embodiment of the bracket of the present invention in a tiled structure other than a wall installation.

FIG. 9 depicts a still further embodiment of the present invention, but in contrast to the embodiments hereinabove described, the embodiment of FIG. 9 is adapted for tile installations other than vertical walls. The embodiment of FIG. 9 depicts an application of the present invention for installing a pull knob 80 on the face of a door 82. The pull knob 80 may be of any conventional type, the spherical knob 80 having a single threaded mounting bolt 84, as depicted, merely being representative. Persons skilled in the relevant art will readily recognize and understand that the present invention is equally adapted and applicable for the mounting of substantially any other form of knob, handle or pull. The door 82 is likewise only illustrative of a substrate to which a knob, handle or pull may be mounted in accordance with the present invention. Persons skilled in the art will also understand that the present invention is equally applicable to the mounting of knobs, handles and pulls to substantially any other substrate, such as for example drawer fronts, partitions, etc.

The embodiment of FIG. 9 employs a bracket 86 similar to that of the embodiment of FIGS. 7 and 8. The bracket 86 has a flat base mounting portion 88 formed of stamped sheet metal with a plurality of perforations 90 formed therein. The bracket 86 is mounted to the face of the door 82 by embedding the base mounting portion 88 into a layer of mortar 16 applied to the door face and then covered by a tile 18, in substantially the same manner as the installation process described above with regard to the preceding embodiments. The tile 18 may be a single tile, as in the depiction of FIG. 9 to provide a decorative base for the knob 80, or the door face could alternatively be covered with an array of tiles. The bracket 86 has a single interiorly-threaded stud 92 as a support portion projecting outwardly from the base mounting portion 88. The tile 18 is formed with a central bore 18A through which the stud 92 projects outwardly to receive the threaded bolt 84 of the knob 80. Alternatively, if an array of multiple tiles are to be bonded to the door face, the stud 92 may be located to project outwardly through a joint between adjacent tiles 18.

Figure 10:
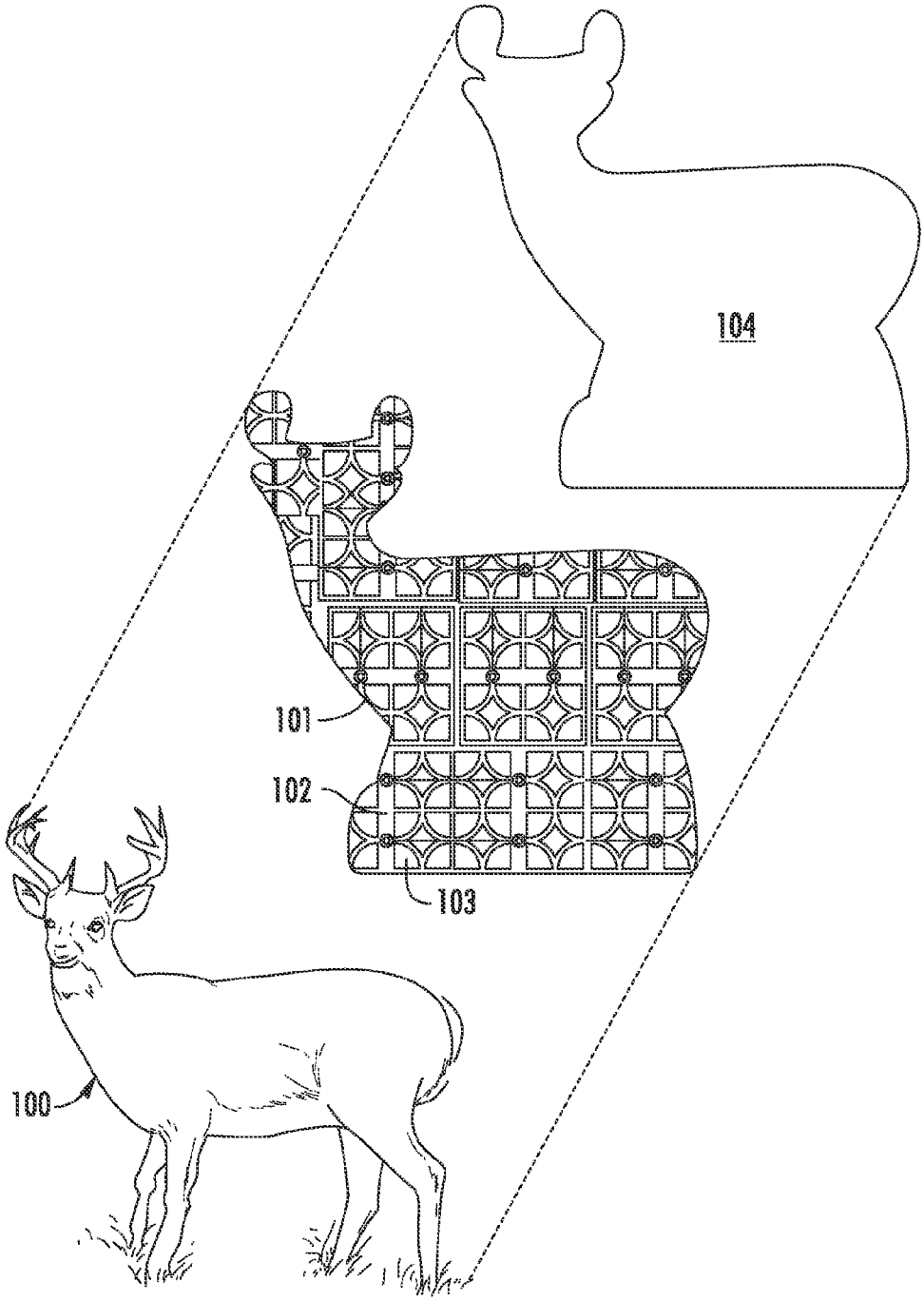
FIG. 10 is another exploded perspective view depicting another embodiment of the bracket of the present invention in another tiled structure other than a wall installation.

FIG. 10 depicts a still further embodiment of the present invention, but in further contrast to the embodiments hereinabove described, the embodiment of FIG. 10 is adapted for tile installations wherein a substrate either is not present or is not desirable. The embodiment of FIG. 10 depicts a representative application of the present invention for creating a self-standing item of tile artwork. Substantially any artistic depiction is possible utilizing tiles of differing colors, shapes and sizes, or by precision waterjet cutting of tile or stone. The artistic rendering of a deer at 100 in FIG. 10 is merely intended to be representative, and could be formed in any such manner. Persons skilled in the art will recognize and understand that other designs such as still life, abstract expressions, etc., are within the conceptual scope of the embodiment of FIG. 10.

In such embodiments, a bracket 101 similar in structure to the brackets of the preceding embodiments serves the dual function of providing a base mounting for the tile art 100 as well as forming a structural substrate for the collective tile structure. The bracket 101 has a flat base mounting portion 102 of stamped sheet metal with a plurality of perforations 103 therein, formed in a shape corresponding to that of the artistic tile design 100. The bracket 101 is encompassed within a quantity of mortar (not shown) penetrating through the perforations 103 to cover both sides of the base mounting portion 102. The artistic tile design 100 is bonded to a forward face of the bracket 101, and any suitable tile or other material, e.g., a reverse image of the design 100 or even a completely different tile design or image only representatively indicated at 104, may be bonded to the opposite side of the bracket 101. Owing to the structural rigidity and strength of the bracket 101, the tile designs, front and back, which are otherwise incapable of being self-supporting on their own, are structurally supported. Thus, this embodiment of the present invention uniquely enables the creation of self-standing self-supporting tile structures not heretofore possible.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A bracket for supporting an accessory from a tiled structure, wherein the tiled structure includes a substrate and a tile veneer bonded to the substrate solely by only a single layer of adhesive mortar without any other bonding material intervening the tile veneer and the substrate and without any mechanical connection between the tile veneer and the substrate or the adhesive mortar, the bracket comprising a base mounting portion and a support portion rigidly affixed to the base mounting portion and projecting outwardly therefrom, the base mounting portion being configured for mounting in a selected localized area of the tiled structure and having a plurality of perforations therethrough for embedding of the base mounting portion in the adhesive mortar at said localized area in abutting relation to the substrate to secure the base mounting portion thereto adhesively without any mechanical connection between the base mounting portion and the substrate or the tile veneer and with the mortar flowing through the perforations to substantially cover opposite sides of the base mounting portion for also adhering the tile veneer over the base mounting portion by the same layer of mortar with the support portion projecting outwardly beyond the tile veneer to receive the accessory.

2. The bracket of claim 1, wherein the support portion comprises a generally flat surface for supporting a planar accessory.

3. The bracket of claim 2, wherein the support portion is adapted to receive a layer of adhesive mortar for bonding of the planar accessory to the support portion.

4. The bracket of claim 3, wherein the support portion has a plurality of perforations therethrough for flow of the mortar through the perforations.

5. The bracket of claim 4, wherein the support portion is adapted for bonding of a first planar accessory to one side of the support portion and a second planar accessory to an opposite side of the support portion.

6. The bracket of claim 1, wherein the bracket comprises first and second base mounting portions angularly oriented to one another for affixation to the substrate at a correspondingly angled corner thereof.

7. The bracket of claim 1, wherein the support portion comprises at least one stud portion configured for receiving a fastener element of an accessory.

8. The bracket of claim 1, wherein the bracket comprises first and second base mounting portions angularly oriented to one another for affixation to the substrate at a correspondingly angled corner thereof, and wherein the support portion comprises first and second stud portions projecting respectively from the first and second base mounting portions.

9. A tiled structure comprising a substrate, a bracket, a tile veneer, and only a single layer of adhesive mortar intervening the substrate, the bracket and the tile veneer for solely bonding both the bracket and the tile veneer to the substrate without any other bonding material or mechanical connection intervening the tile veneer, the bracket and the substrate, the bracket comprising a base mounting portion and a support portion rigidly affixed to the base mounting portion and projecting outwardly therefrom, the base mounting portion being configured for mounting in a selected localized area of the tiled structure and having a plurality of perforations therethrough, the base mounting portion being embedded in the adhesive mortar at said localized area in abutting relation to the substrate securing the base mounting portion thereto adhesively without any mechanical connection between the base mounting portion and the substrate or the tile veneer and with the mortar flowed through the perforations and substantially covering opposite sides of the base mounting portion, the tile veneer bonded also to the same layer of adhesive mortar over the base mounting portion with the support portion projecting outwardly beyond the tile veneer, and an accessory affixed to the support portion.

10. The tiled structure of claim 9, wherein the support portion comprises a generally flat surface for supporting a planar accessory.

11. The tiled structure of claim 10, wherein the support portion is adapted to receive a layer of adhesive mortar for bonding of the planar accessory to the support portion.

12. The tiled structure of claim 11, wherein the support portion has a plurality of perforations therethrough for flow of the mortar through the perforations.

13. The tiled structure of claim 12, wherein the support portion is adapted for bonding of a first planar accessory to one side of the support portion and a second planar accessory to an opposite side of the support portion.

14. The tiled structure of claim 9, wherein the bracket comprises first and second base mounting portions angularly oriented to one another for affixation to the substrate at a correspondingly angled corner thereof.

15. The tiled structure of claim 9, wherein the support portion comprises at least one stud portion configured for receiving a fastener element of an accessory.

16. The tiled structure of claim 9, wherein the bracket comprises first and second base mounting portions angularly oriented to one another for affixation to the substrate at a correspondingly angled corner thereof, and wherein the support portion comprises first and second stud portions projecting respectively from the first and second base mounting portions.

17. The tiled structure of claim 9, wherein the tile veneer comprises a plurality of individual tiles adjacently arranged over the substrate at spacings defining joints between adjacent tiles, the support portion projecting outwardly through a joint between adjacent tiles.

18. The tiled structure of claim 9, wherein the substrate is porous for penetration thereof by the adhesive mortar.

19. The tiled structure of claim 9, wherein the tile veneer is porous for penetration thereof by the adhesive mortar.

20. The tiled structure of claim 9, wherein the adhesive mortar comprises a polymer-modified thin-set mortar.

21. The tiled structure of claim 9, wherein the tiled structure is a vertical wall with the substrate in an upright orientation.

22. The tiled structure of claim 21, wherein the accessory is a wall accessory.

23. The tiled structure of claim 9, wherein the accessory is a seat or other form of shelf, a tray, a basket, a support bar, a support ring, a hook, a hanger, a knob, a pull, or an item of art.

24. A tiled structure comprising only a single layer of adhesive mortar without any other bonding material in the tiled structure, a bracket comprising a base mounting portion having a plurality of perforations therethrough, the base mounting portion being embedded in the adhesive mortar in a selected localized area of the tiled structure without any mechanical support for the base mounting portion and with the mortar flowed through the perforations and substantially covering opposite sides of the base mounting portion, and a tile veneer bonded to the same layer of adhesive mortar over at least one side of the base mounting portion.

* * * * *